United States Patent [19]

Lautenschlager

[11] 4,193,163

[45] Mar. 18, 1980

[54] KNUCKLE JOINT HINGE

[75] Inventor: Reinhard Lautenschläger, Reinheim, Fed. Rep. of Germany

[73] Assignee: Karl Lautenschlager KG, Mobelbeschlagfabrik, Reinheim, Fed. Rep. of Germany

[21] Appl. No.: 902,059

[22] Filed: May 2, 1978

[30] Foreign Application Priority Data

May 13, 1977 [DE] Fed. Rep. of Germany ..... 2721620

[51] Int. Cl.[2] ..... E05D 11/00

[52] U.S. Cl. ..... 16/137; 16/167; 16/163

[58] Field of Search ..... 16/180, 167, 182, 183, 16/164, 163, 137, 128

[56] References Cited

U.S. PATENT DOCUMENTS

| | | | |
|---|---|---|---|
| 3,363,281 | 1/1968 | Borsani | 16/183 X |
| 3,952,367 | 4/1976 | Schnelle et al. | 16/180 X |
| 4,075,735 | 2/1978 | Rock et al. | 16/180 X |
| 4,091,498 | 5/1978 | Lautenschlager | 16/137 X |
| 4,094,040 | 6/1978 | Schmid et al. | 16/180 X |

*Primary Examiner*—George H. Krizmanich

[57] ABSTRACT

A knuckle joint hinge having a supporting-wall and a door part which are joined together by a knuckle joint mechanism formed by two link arms coupled pivoting together in their middle area, one end of the one link arm being articulated to the supporting-wall part and one end of the other link arm to the door part, the other end in each case being guided along a curve in space and coupled to the respective other part. In the portion of the knuckle joint mechanism that is formed by the door-side lever arms of the link arms, a filler piece is mounted so as to be variable in position. This filler piece is biased into a position covering the variable gaps which form between the door-side lever arms and between the lever arms and the door during the opening and closing movement, and it supports itself against the door or the door part, as the case may be, by means of a cam on its side facing the door.

15 Claims, 7 Drawing Figures

FIG. 3
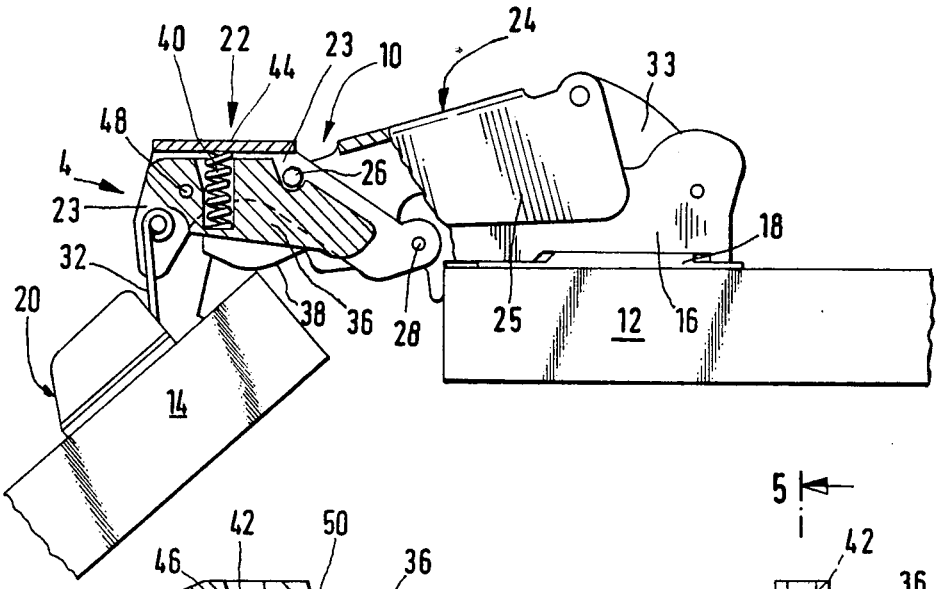
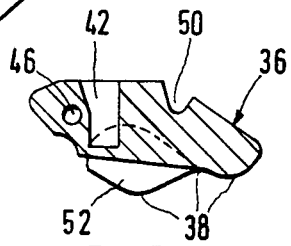
FIG. 5
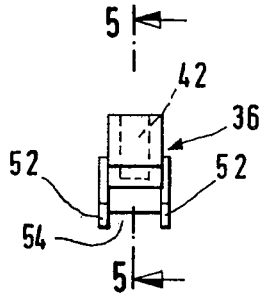
FIG. 4
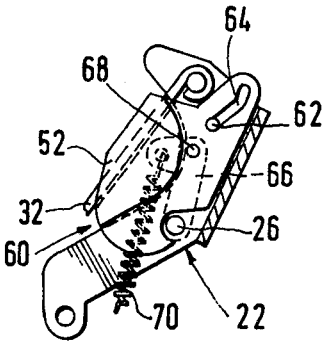
FIG. 6
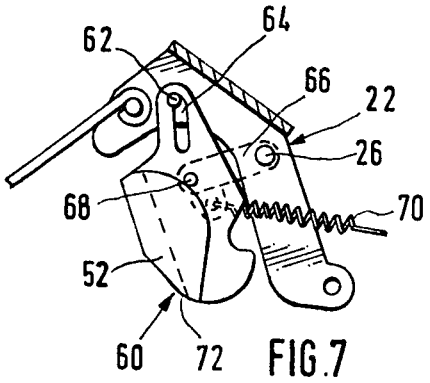
FIG. 7

KNUCKLE JOINT HINGE

BACKGROUND

The invention concerns a knuckle joint hinge for furniture, having a supporting-wall part and a door part which are joined together by a knuckle joint mechanism formed by two link arms coupled pivotingly together in their central area, one of the extremities of one link arm being articulated to the supporting-wall part and one of the extremities of the other link arm being articulated to the door part, the other end in each case being guided along a curve in space and coupled to the other respective mounting part.

Knuckle joint hinges of this kind are increasingly used by furniture manufacturers because, by means of the knuckle joint mechanism, a motion can be realized which permits the door mounted on a carcase by such a hinge to open by 180° even when another door directly adjoins it laterally, as for example in the case of built-in cabinets. The above-mentioned guidance of one end of each link arm along a curve in space can be accomplished either directly by guiding the link arm end in a cam track provided on the mounting part in question, or indirectly by means of an interposed link.

When a door mounted by a knuckle joint hinge swings from the closed to the open position, the link arms perform scissors-like swinging movements relative to one another and also movements relative to the mounting parts, whereupon gaps of varying size develop, especially between the doorside lever arms of the link arms, but also between the link arm closer to the door and the inside surface of the door. These size-varying gaps are hazardous in two ways. On the one hand, loose articles of clothing hung in the cabinet can be pinched in them and damaged, and on the other hand, children can accidentally get their fingers pinched and injured in them.

The invention is therefore addressed to the problem of improving the known knuckle joint hinges such that the above-mentioned injuries due to the pinching of fingers or the damaging of clothing will no longer be possible.

Setting out from the knuckle joint hinge of the initially mentioned kind, this problem is solved in accordance with the invention in that a filler piece is mounted for change of position in the area of the knuckle joint mechanism formed by the door-side lever arms of the link arms, which is urged by a biased spring into a position covering the variable gaps developing between the lever arms and the door in the opening and closing movement, and is supported at its extremity facing the door against the door or the door-related mounting part by means of a control cam. It has been found that there is sufficient space within the projection of the link arms for the accommodation of such a filler, which, if the control cam is appropriately shaped, will largely cover the variable gaps between the link arms and between the link arms and door in every closing or opening position.

If the knuckle joint hinge is, in a conventional manner, so constructed that the link arms each have two parallel sidewalls disposed in a spaced relationship to one another, it is recommended that the filler be disposed and mounted at least partially in the space formed between the parallel sidewalls, since the filler will then be virtually invisible.

If the filler is mounted between the sidewalls of the link arm articulated to the supporting-wall part and guided along a curve in space with the door part, and the coupling of the link arm to the door part is accomplished by means of a link, a recess is provided in the filler in the side facing the door, in further development of the invention, into which the link snaps when the hinge is approaching the closed position. The link thus does not limit the size of the profile of the filler, so that the lateral filler areas required for the covering of the hazardous gaps can be realized.

In a preferred embodiment of the invention, the filler is pivotingly mounted in or on the associated link arm and is biased by the spring in the sense of a swing toward the door. This pivoting mounting of the filler can be accomplished quite simply by means of a pin passed through aligned bores in the sidewalls of the link arm and in the filler.

If the two sidewalls of the link arm accommodating the filler between them are closed at their sides facing away from the door by a spanning portion forming a U-shaped profile in cross section, the spring biasing the filler is constructed preferably as a compression spring thrusting at one end against the inside of the spanning portion and at the other end against or inside the filler.

In an alternative embodiment of the invention, the filler can also be guided by a cam and can be held by the cam for pivoting in or on the associated link arm, in which case it is then also coupled to the link arm by a filler link. By means of this slightly more complex mounting of the filler, the hazardous spaces between the link arms can be covered to a slightly greater extent than in the case of a merely pivotal linking of the filler.

The filler link is mounted at the link arm end preferably on the pintle coupling the link arms together in their central area to form the knuckle joint mechanism, i.e., no separate pin is required for this end of the filler link.

Since the filler link enters a recess in the filler and therefore the space available for the accommodation of a compression spring is limited, it is then recommendable to construct the spring as a tension spring whose one end is attached to the filler link adjacent its pivot at the filler end of the latter, and whose other end is attached to the supporting-wall part of the hinge.

For the sake of simple and economical manufacture, the filler is made of plastic, as is also, if desired, the filler link.

The invention will be further explained hereinafter with reference to two embodiments, in conjunction with the appended drawings, wherein:

FIGS. 1 to 3 are partially cutaway and cross-sectional views of a first embodiment of a knuckle joint hinge of the invention, showing the door mounted by the hinge in the closed position, in a position in which it is open at approximately 90°, and in a position in which it open to more than 90°;

FIG. 4 is an end view of the filler used in the knuckle joint hinge of FIGS. 1 to 3, as seen in the direction of the arrow 4 in FIG. 3;

FIG. 5 is a cross sectional view taken along the arrows 5—5 of FIG. 4, and FIGS. 6 and 7 are diagrammatic views of the arrangement of a filler differing from the filler used in FIGS. 1 to 5, in two different positions in the associated link arm, namely in the positions corresponding to FIG. 1 and FIG. 2, respectively.

Figure 1:
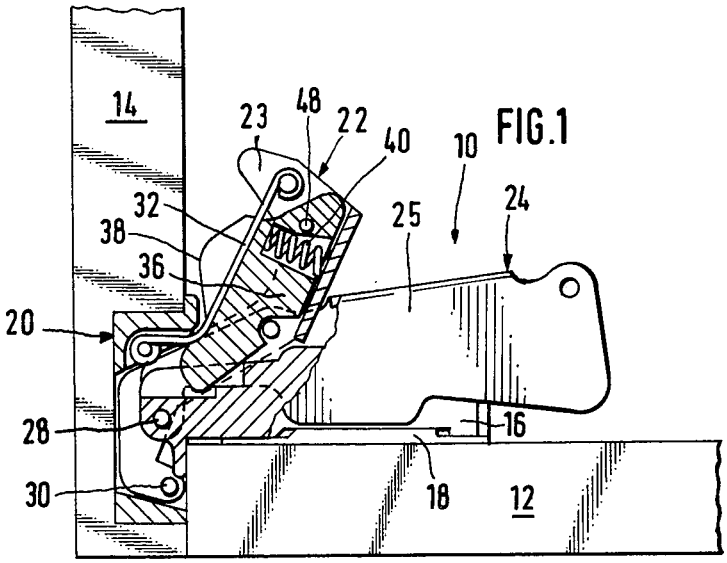
Figure 2:
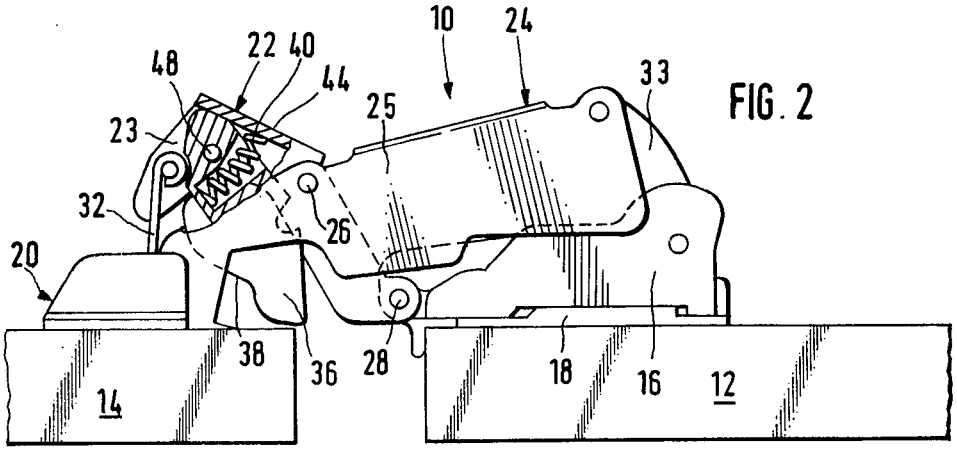

The knuckle joint hinge shown in FIGS. 1 to 3, and designated as a whole by the numeral 10, permits the door to open to more than 90°, preferably to as much as 180°. The knuckle joint hinge 10 serves to fasten a door 1e to a supporting wall 12 of a cabinet. The supporting-wall part 16 of the hinge is fastened in a conventional manner to the supporting wall 12 by means of a mounting plate 18. The door part 20 has the likewise very widely used form of a snap-in cup made of plastic or of metal by the injection molding or die casting method.

The knuckle joint articulation is formed by two link arms 22 and 24 each having two parallel sidewalls 23 and 25, which are journaled together in their central area by a pin 26, the inner sides of the sidewalls 25 of link arm 24 overlapping the sidewalls 23 of link arm 22 with slight clearance. The link arm 22 is journaled on the supporting-wall part 16 by means of a pin 28 and the link arm 24 is journaled on the door part 20 by means of a pin 30.

To the other, swinging end of the link arm 22 there is articulated a link 32 which is articulated at its other end to the door part 20, and which guides this end of link arm 22 on an arcuate curve in space. The second end of the link arm 24 is likewise coupled by a link 33 to the wall part 16. The knuckle joint hinge described thus far is the same as the known hinges of this type.

In the improvement in accordance with the invention, however, a filler 36 is mounted in the door-side lever arm of link arm 22 between the sidewalls 23 thereof, and extends back beyond the link pin 26 all the way to the area of the lever arm on the supporting wall side; it projects on the door side beyond the sidewalls 23 and there it assumes the form of a cam lobe 38 which can slide on the inside of the door or on the door part 20, depending on the position of the door 14. A compression spring in the form of a helical spring 40 is inserted in a recess 42 of filler 36 and the end of it, which projects from the filler, thrusts against the inside of a spanning portion 44 joining together the sidewalls 23 to form a profile of U-shaped cross section. By means of a pin 48 passing through a bore 46 in the filler and corresponding bores in the sidewalls 23, the filler 36 is held pivotingly in the manner shown in FIGS. 1 to 3 between the sidewalls 23, the spring 40 biasing the filler in the sense of swinging such that the cam lobe 38 is held in constant engagement with the inside of the door or the door part of the hinge, as the case may be. It can be seen that the filler 36 in every door position covers most of the hazardous spaces of varying size between the link arms 22 and 24 on the one hand and the link arms and the inside of the door on the other, so that the desired protection against the pinching of clothing or fingers is assured.

In FIGS. 4 and 5 the filler 36 is represented separately. It can be seen that a transverse notch 50 is provided in its rear side facing away from the door, in addition to the previously mentioned recess 42 for the compression spring 40, for the purpose of accommodating the pin 26 when the filler 36 is pushed back all the way between the sidewalls 23. In the lower side facing the door 14 and provided with the cam 38, a recess 54 is formed in the filler between two laterally attached plates 52, which is entered by the link 32 in the closed position shown in FIG. 1. The lateral plates 52 of the filler are formed in the areas protruding from the sidewalls 23 of the link arm 22. A portion of the cam 38 is on these plates 52. In the area of the plates 52, the width of the filler, as measured across their outer surfaces, is approximately equal to the width measured across the outsides of the sidewalls 23 of the link arm 22. In this manner the inside width of the recess 54 can be made relatively great, so that the link 32 can be made from an appropriately wide and strong metal strip material.

FIGS. 6 and 7 show a slightly modified embodiment of a filler 60 for a knuckle joint hinge which is otherwise the same as the knuckle joint hinge 10, only the link arm 22 being shown for the sake of clarity, so that the different relative positions which the filler 60 can assume can be illustrated. The position represented in FIG. 6 corresponds to the hinge-closed position illustrated in FIG. 1, while the position shown in FIG. 7 occurs approximately when the door is open to an angle of 90° as shown in FIG. 2. It can be seen that the filler 60, which is similar in principle to filler 36, is mounted on a pin 62 corresponding to the pin 48, but a guiding slot 64 permits a limited displacement of the filler in addition to its swinging movement. Additionally, the filler 60 is guided by a filler link 66. The one end of the link 66 is journaled within the filler at 68 and the other end is journaled on the pintle 26 joining the link arms 22 and 24 to form the crosslink. As a result of the combination of the guiding slot or cam 64 with the guidance provided by the link 66, an even better shielding of the hazardous spaces is achieved, although the linkage is evidently a little more complex. The spring bias in this case is produced by a tension coil spring 70, which at one end is hooked to the filler link 66 adjacent the pivot point 68 and at the other end is attached to the supporting-wall part 16. Otherwise, the filler 60 again has the lateral plates 52 used with filler 36, and accordingly also a recess which is not shown and which corresponds to recess 54. The cam 72 on the filler 60 is formed mainly by the door-side edges of the lateral plates 52 of filler 60.

I claim:

1. A knuckle joint hinge for a piece of furniture having a door, said hinge having a supporting-wall part and a door part, a knuckle joint mechanism joining said parts and being formed by two link arms coupled pivotingly together in their middle area and each forming two lever arms, one of which is on the door side, one end of one link arm being articulated to the supporting-wall part and one end of the other link arm being articulated to the door part, the other end of said one link arm being guided along a curve in space and coupled to said door part, and the other end of said other link arm being guided along a curve in space and coupled to said suporting-wall part, a filler piece mounted in the portion of the knuckle joint mechanism formed by the door-side lever arms of the link arms facing said door part so as to be variable in position, and a pre-tensioned spring biasing said filler piece into a position covering the variable gaps which form between the door-side lever arms and between the lever arms and the door during the opening and closing movement of the hinge, and a cam associated with said filler piece, said filler piece supporting itself against one of said door and door part, by means of said cam on the side of the filler piece facing the door.

2. A knuckle joint hinge according to claim 1, in which the link arms have each two sidewalls disposed in parallel spaced relationship, said filler piece being at least partially disposed and mounted in the space formed between the parallel sidewalls.

3. A knuckle joint hinge according to claim 2, wherein the filler piece protrudes from the profile of the sidewalls accommodating it, to the dimension of the distance between the outsides of the sidewalls.

4. A knuckle joint hinge according to claim 3, in which the filler piece is mounted between the sidewalls of the link lever arm which is articulated to the supporting-wall part and is coupled to the door part for guidance along a curve in space, and a link coupling the link lever to the door part, a recess being provided in the filler piece in the side thereof facing the door, into which recess the link is received when the hinge approaches its closed position.

5. A knuckle joint hinge according to any one of claims 1 to 4, wherein the filler piece is mounted pivotingly in one of said link arms and is biased by said spring in the sense of a swinging toward the door.

6. A knuckle joint hinge according to any one of claims 1 to 4, wherein the filler piece is mounted pivotingly on one of said link arms and is biased by said spring in the sense of a swinging toward the door.

7. A knuckle joint hinge according to claim 5, comprising a spanning portion closing the two sidewalls of the link arm accommodating the filler piece between them on those sides thereof which face away from the door, to form a profile of U-shaped cross section, said spring being a compression spring resting at one end against the inside of the spanning portion and at the other end against the filler piece.

8. A knuckle joint hinge according to claim 6, comprising a spanning portion closing the two sidewalls of the link arm accommodating the filler piece between them on those sides thereof which face away from the door, to form a profile of U-shaped cross section, said spring being a compression spring resting at one end against the inside of the spanning portion and at the other end against the filler piece.

9. A knuckle joint hinge according to claim 5, comprising a spanning portion closing the two sidewalls of the link arm accommodating the filler piece between them on those sides thereof which face away from the door, to form a profile of U-shaped cross section, said spring being a compression spring resting at one end against the inside of the spanning portion and at the other end in the filler piece.

10. A knuckle joint hinge according to claim 6, comprising a spanning portion closing the two sidewalls of the link arm accommodating the filler piece between them on those sides thereof which face away from the door, to form a profile of U-shaped cross section, said spring being a compression spring resting at one end against the inside of the spanning portion and at the other end in the filler piece.

11. A knuckle joint hinge according to any one of claims 1 to 4, comprising a cam guiding the filler piece, said filler piece being held by the cam for pivoting at the associated link arm, and a filler link coupling said filler piece to the link arm.

12. A knuckle joint hinge according to claim 11, comprising a pintle which couples the link arms in their central area to form the knuckle joint mechanism, said filler link being journaled at the link arm end on said pintle.

13. A knuckle joint hinge according to claim 12, said spring being a tension spring attached to the filler link adjacent the journal of the filler piece end of the link, the other end being fastened to the supporting-wall part.

14. A knuckle joint hinge according to any one of claims 1 to 4, comprising a cam guiding the filler piece, said filler piece being held by the cam for pivoting at the associated link arm, and a filler link coupling said filler piece to the link arm, said spring being a tension spring attached to the filler link adjacent the journal of the filler piece end of the link, the other end being fastened to the supporting-wall part.

15. A knuckle joint hinge according to any of claims 1 to 4, wherein the filler piece is made of plastic.

* * * * *